US006967542B2

(12) United States Patent
Weinstein

(10) Patent No.: US 6,967,542 B2
(45) Date of Patent: Nov. 22, 2005

(54) MICROSTRIP-WAVEGUIDE TRANSITION

(75) Inventor: Michael E. Weinstein, Orlando, FL (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 10/608,096

(22) Filed: Jun. 30, 2003

(65) Prior Publication Data

US 2004/0263280 A1 Dec. 30, 2004

(51) Int. Cl.[7] ..... H01P 5/107
(52) U.S. Cl. ..... 333/26; 333/33; 333/248
(58) Field of Search ..... 333/26, 33, 35, 333/248

(56) References Cited

U.S. PATENT DOCUMENTS

| | | | | |
|---|---|---|---|---|
| 3,675,165 | A | 7/1972 | Ueda et al. | |
| 3,781,726 | A | 12/1973 | Thompson | |
| 3,860,891 | A | 1/1975 | Hiramatsu | |
| 4,556,854 | A | 12/1985 | Hiramatsu | |
| 4,686,498 | A | 8/1987 | Carr et al. | |
| 4,740,764 | A | 4/1988 | Gerlack | |
| 5,198,786 | A | 3/1993 | Russell et al. | |
| 5,235,300 | A | 8/1993 | Chan et al. | |
| 5,376,901 | A | 12/1994 | Chan et al. | |
| 5,481,234 | A | 1/1996 | Landry et al. | |
| 5,539,361 | A * | 7/1996 | Davidovitz | 333/26 |
| 5,793,263 | A | 8/1998 | Pozar | |
| 5,801,599 | A | 9/1998 | Flynn et al. | |
| 5,867,073 | A * | 2/1999 | Weinreb et al. | 333/26 |
| 5,912,598 | A * | 6/1999 | Stones et al. | 333/26 |
| 5,994,975 | A | 11/1999 | Allen et al. | |
| 6,201,453 | B1 * | 3/2001 | Chan et al. | 333/26 |
| 6,396,363 | B1 * | 5/2002 | Alexanian et al. | 333/26 |
| 6,486,748 | B1 * | 11/2002 | Stones et al. | 333/26 |
| 6,580,335 | B1 * | 6/2003 | Iizuka et al. | 333/26 |

* cited by examiner

*Primary Examiner*—Vibol Tan
(74) *Attorney, Agent, or Firm*—Buchanan Ingersoll PC

(57) ABSTRACT

A microstrip-waveguide transition for transmission of electromagnetic energy includes a waveguide having an open end, a dielectric substrate attached to the open end, a microstrip probe on the dielectric substrate, wherein a capacitive susceptance occurs across the open end when the open end is exposed to electromagnetic energy and wherein the capacitive susceptance is countered with inductive susceptance.

12 Claims, 2 Drawing Sheets

MICROSTRIP-WAVEGUIDE TRANSITION

BACKGROUND

1. Field of Invention

The present device relates generally to the interconnection of components for the transmission of electromagnetic energy. More specifically, the device relates to a transition for interconnecting a microstrip and a waveguide.

2. Background Information

A microstrip-waveguide transition is an apparatus for the transmission of electromagnetic energy between a microstrip transmission line and a waveguide. Present microstrip-waveguide transitions can take several forms. For example, the microstrip can be inserted perpendicularly into an opening within a wall of the waveguide, the microstrip can be inserted collinearly into the open end of the waveguide, or the waveguide can be mounted perpendicularly to the microstrip ground plane.

These basic forms are suitable for most applications of a transition. However, there remain applications where the basic forms are not used due to space constraints and performance requirements. For example, in a phased array having multiple waveguide ports, the available space limits the dimensions of the microstrip-waveguide transition. In addition, some applications require a hermetic seal between the microstrip and the waveguide. For larger millimeter wave phased array systems (e.g., those having thousands of waveguide ports), the labor cost can become impractical. Even with modern automated assembly equipment, the construction time is affected by need for alignment in the interconnect systems used today.

SUMMARY OF THE INVENTION

Exemplary embodiments are directed to a microstrip-waveguide transition for transmission of electromagnetic energy including a waveguide having an open end, a dielectric substrate attached to the open end, a microstrip probe on the dielectric substrate, wherein a capacitive susceptance across the open end when the open end is exposed to electromagnetic energy, and a means for countering the capacitive susceptance with inductive susceptance.

Exemplary embodiments are also directed to a microstrip-waveguide transition including a waveguide having an open end, a dielectric substrate having a first side surface attached to the open end, two separated conductive plates on the first side surface, and a microstrip probe on a second side surface of the dielectric substrate.

Exemplary embodiments are also directed to a microstrip-waveguide transition including a waveguide having an open end, a dielectric substrate having a first side surface attached to the open end, a microstrip probe on a second side surface of the dielectric substrate, a backshort cap attached to the second side surface, and wherein the backshort cap has a central portion at a height in relation to the microstrip probe that is less than ½ of a wavelength for a frequency at which the microstrip-waveguide transition operates.

Exemplary embodiments are also directed to a microstrip-waveguide transition including a waveguide having an open end, a dielectric substrate having a first side surface attached to the open end, a microstrip probe on a second side surface of the dielectric substrate, a backshort cap attached to the second side surface, and wherein corners of the waveguide, and backshort cap are in alignment. As shown in FIG. 3, a dielectric substrate can be held within the microstrip-waveguide transition, the backshort cap being in alignment with the waveguide.

BRIEF DESCRIPTION OF THE DRAWINGS

Other objects and advantages of the present invention will become apparent to those skilled in the art upon reading the following detailed description of exemplary embodiments, in conjunction with the drawings of the exemplary embodiments.

DETAILED DESCRIPTION OF THE PREFERRED EMBODIMENTS

Figure 1:
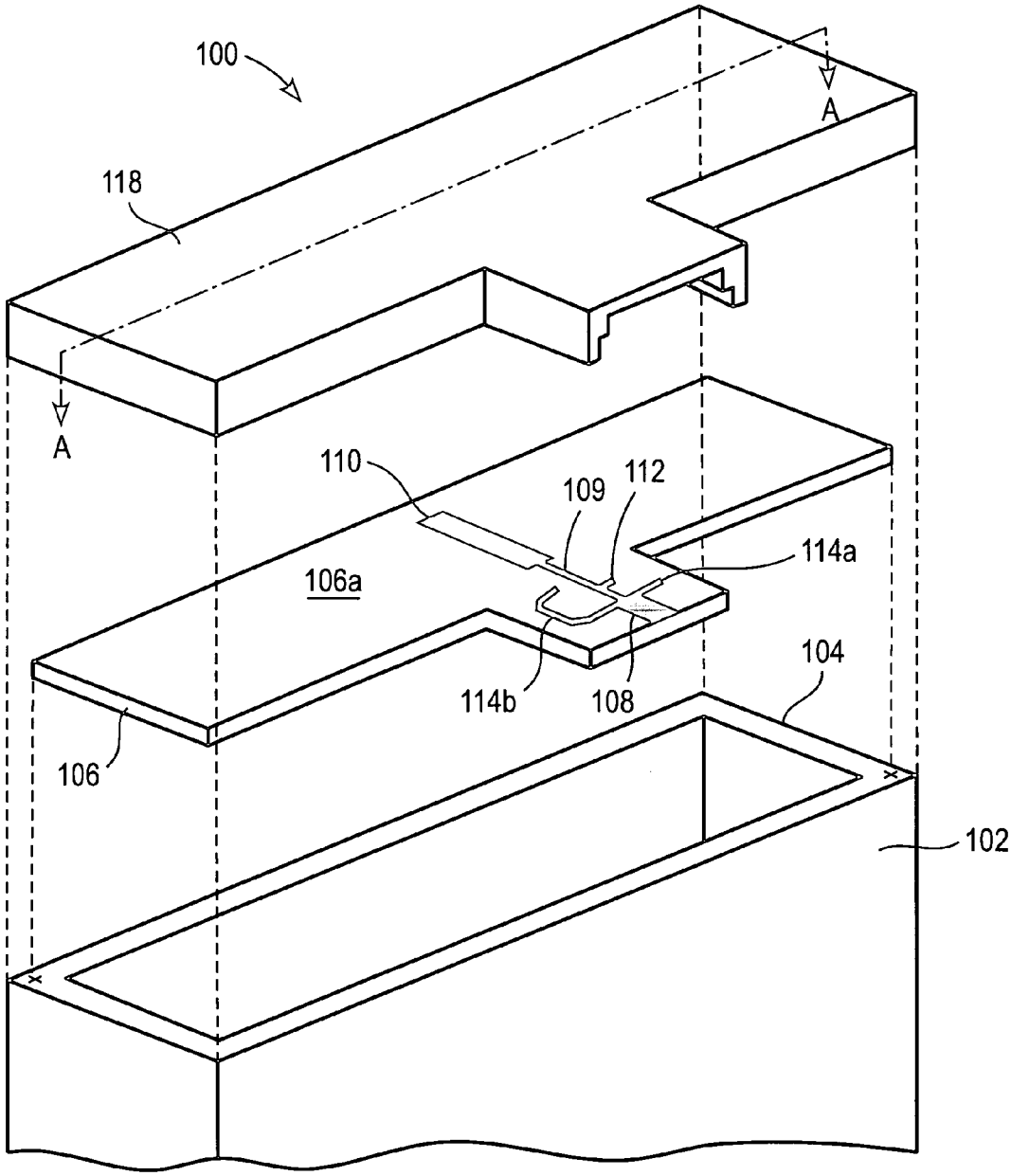
FIG. 1 is an exploded perspective view of an exemplary embodiment of the invention.

As shown in the exploded perspective view of the exemplary embodiment in FIG. 1, a microstrip-waveguide transition 100 includes a waveguide 102 with an open end 104, which, for example, can be a half-height waveguide opening, a full-height waveguide opening or any other suitable opening size. The open end 104 of the waveguide 102 is attached to a dielectric substrate 106. The microstrip-waveguide transition 100 includes a microstrip 108 and a microstrip probe 110 positioned on a side surface 106*a* of the dielectric substrate 106 opposite to the side surface of the dielectric substrate on which the waveguide 102 is attached. The microstrip-waveguide transition 100 also includes a microstrip ground on the side surface of the dielectric substrate on which the waveguide 102 is attached. The dielectric substrate 106 above the open end 104 of the waveguide 102 presents a capacitive susceptance across the open end 104 of the waveguide 102 when the open end is exposed to electromagnetic energy. Such a capacitive susceptance can interfere with the transmission of electromagnetic energy between the microstrip 108 and the waveguide 102 so as to cause losses that are unacceptable. Therefore, a means of countering the effect of the capacitive susceptance with inductive susceptance can be utilized to minimize or eliminate the effect of the capacitive susceptance on the transmission of the electromagnetic energy to an amount that will enable use of the microstrip-waveguide transition for an intended application.

As shown by the dashed vertical lines in FIG. 1, the waveguide 102, dielectric substrate 106 and backshort cap 118 can be aligned. For example, the corners of the waveguide 102 are aligned with the corners of the backshort cap 118, with the corners of the the dielectric substrate 106 arranged between the backshort cap 118 and the dielectric substrate during assembly of the microstrip-waveguide transition 100. The corners of the dielectric substrate 110 can be aligned to rest on a flush or recessed surface of the open end 102 of the waveguide 118 or the either the backshort cap 118 or the open end 102. Therefore, corners of the waveguide 102, dielectric substrate 110 and backshort cap 118 of the microstrip-waveguide 100 will be in alignment.

As shown in FIG. 1, the dielectric substrate 110 completely covers the open end 104 of the waveguide 102 to form a hermetic barrier between the microstrip 108 and the waveguide 102. The dielectric substrate 110 can comprise a single layer of dielectric material, for example, alumina, insulating polymers or any other insulating material. In the alternative, the dielectric substrate 110 can comprise multiple layers of different dielectric materials. For example, the dielectric substrate 110 can be two layers of silicon dioxide sandwiching a layer of silicon nitride (e.g., oxide-nitride-oxide) or multiple layers of any other suitable insulating materials. The dielectric substrate should have a thickness of 5 to 100 mils or any other thickness sufficient to form the hermetic barrier and/or support the microstrip 108.

The microstrip 108, as shown in FIG. 1, can have other features that enhance performance characteristics of the microstrip-waveguide transition. For example, double-tuning stubs 114*a* and 114*b* can be added to increase the frequency bandwidth at which the microstrip-waveguide transition operates. In addition or in the alternative, an impedance transformer 109 can be used to adjust the impedance level. In addition, an open-circuit stub 112 can be used to make small adjustments to the impedance level. Other types of bandwidth and tuning structures can also be used.

Figure 2:
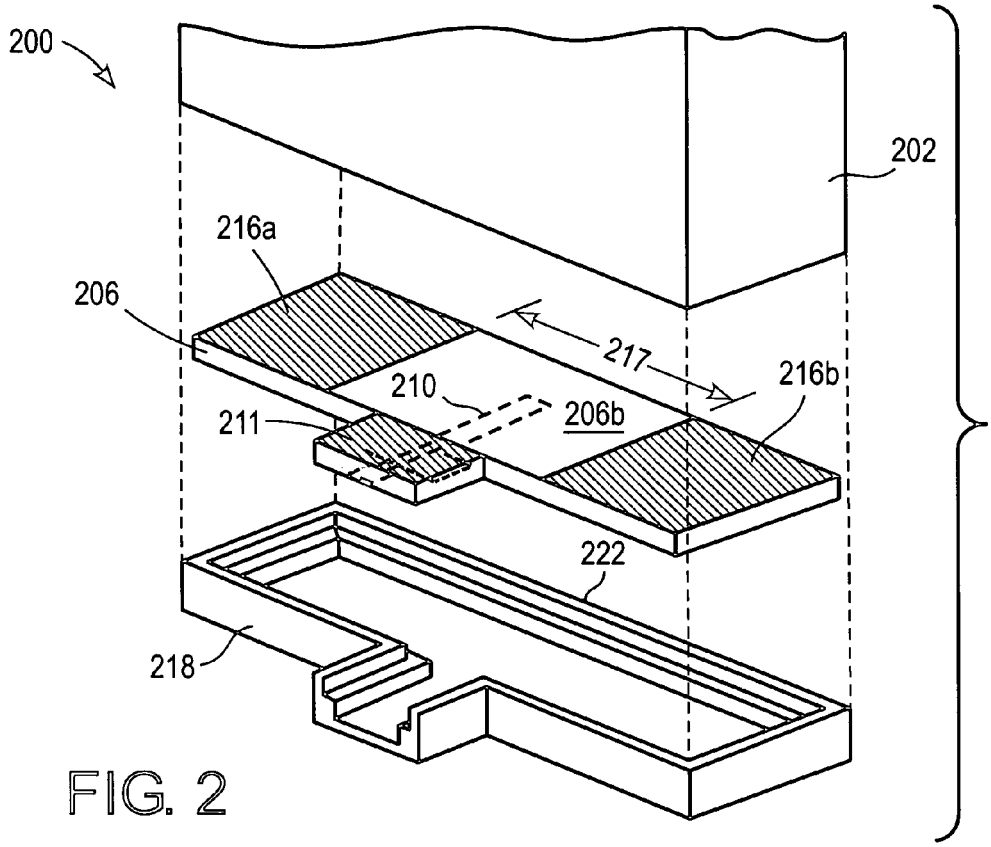
FIG. 2 is another exploded perspective view of an exemplary embodiment of the invention.

At least a portion of the capacitive susceptance across the open end of a waveguide can be countered with two separated conductive plates on the side surface of the dielectric substrate attached to the waveguide. As shown in the exemplary embodiment of FIG. 2, a microstrip-waveguide-transition 200 can have a first conductive plate 216*a* and a second conductive plate 216*b* that are separated by an opening 217. The first conductive plate 216*a* and a second conductive plate 216*b* are formed on the side surface 206*b* of the dielectric substrate 206 that attaches to the waveguide 202. The opening 217 between the two separated conductive plates 216*a*/216*b* acts as an iris for the waveguide 202 when the waveguide 202 is attached. The microstrip probe 210 on the other side of the dielectric substrate is substantially centered with respect to the opening 217, as shown in FIG. 2. An inductive susceptance is created based upon the width of the opening 217 of the iris for the waveguide 202 in relation to the microstrip probe 210 that counters at least a portion of the capacitive susceptance across the open end 204. The microstrip-waveguide transition 200 also includes a microstrip ground 211 formed on the side surface of the dielectric substrate on which the waveguide 202 is attached. The microstrip ground 211 covers the portion of the surface of the dielectric substrate opposite the microstrip 208 but leaves the surface of the dielectric substrate opposite the microstrip probe 210 uncovered (e.g., at the opening 217).

The exemplary embodiment of FIG. 2 illustrates the interior surface of a backshort cap 218. Because the backshort cap 218 is hollow, a central portion 220 (i.e., the interior surface of the backshort cap directly under the microstrip probe) of the backshort cap is directly above the other side of the dielectric substrate 206. The peripheral walls 222 of the backshort cap 218 are attached to the other side surface of the dielectric substrate 206 with an adhesive to form a hermetic seal between the backshort cap 218 and the dielectric substrate 206. The adhesive can be a conductive adhesive such as solder, conductive epoxy or any other materials suitable as a conductive adhesive. Furthermore, the microstrip ground 211 is conductively connected to the open end of the waveguide 202.

At least a portion of the capacitive susceptance across the open end of a waveguide can be countered with a backshort cap attached to the side surface of the dielectric substrate on which the microstrip is positioned. As shown in the exemplary embodiment of FIG. 3, a waveguide-transition 300 can have a backshort cap 318 that has a central portion 320 at a height H in relation to the microstrip probe 310. The backshort cap 318 is formed of a conductive material. The height H should be less than ½ of a wavelength for a frequency at which the microstrip-waveguide transition operates. An inductive susceptance is created based upon the height H of a central portion of an interior surface of the backshort cap 318 in relation to the microstrip probe 310. The inductive susceptance from the backshort cap can be substantially equivalent (e.g., 10% difference) to the inductive susceptance from the two separated conductive plates. Both of these susceptances together can counter or tune out the capacitive susceptance across the open end due to the microstrip.

Figure 3:
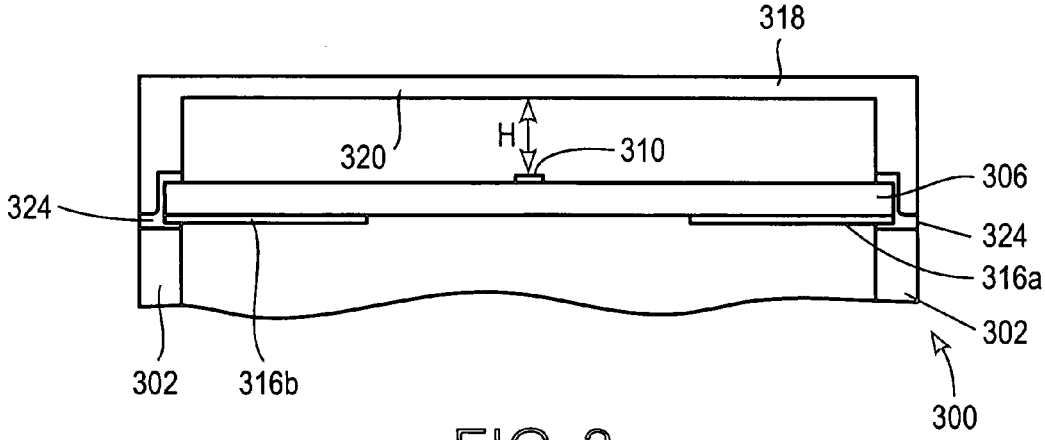
FIG. 3 is an assembled cross-sectional view of an exemplary embodiment of the invention along a line similar to line A–A' shown in FIG. 1.

The open end of the waveguide 302 in the exemplary embodiment of FIG. 3 is attached to the backshort cap 318 with solder, conductive epoxy or any other suitable conductive adhesive 324. The backshort cap 318 can also be attached to the dielectric substrate 306. As shown in FIG. 3, the conductive adhesive 324 is also in contact with the separated conductive plates 316*a* and 316*b* that form the iris for the waveguide 302. In an alternative, the separated conductive plates 316*a* and 316*b* could be formed independently from the dielectric substrate and be attached to the open end of the waveguide. Then, the backshort cap would be attached by a conductive adhesive to both the separated conductive plates and the open end of the waveguide.

Although the present invention has been described in connection with preferred embodiments thereof, it will be appreciated by those skilled in the art that additions, deletions, modifications, and substitutions not specifically described may be made without a department from the spirit and scope of the invention as defined in the appended claims.

What is claimed is:

1. A microstrip-waveguide transition comprising:

a waveguide having an open end;

a dielectric substrate having a first side surface attached to the open end;

two separated conductive plates on the first side surface; and a microstrip probe on a second side surface of the dielectric substrate.

2. The microstrip-waveguide transition according to claim 1, wherein corners of the waveguide and the dielectric substrate are in alignment.

3. The microstrip-waveguide transition according to claim 1, comprising:

a backshort cap attached to the second side surface of the dielectric substrate; and wherein the backshort cap has a central portion at a height in relation to the microstrip probe that is less than ½ of a wavelength for a frequency at which the transition operates.

4. The microstrip-waveguide transition according to claim 2, wherein the backshort cap is attached to the open end with a conductive adhesive to form a hermetic seal.

5. The microstrip-waveguide transition according to claim 2, wherein the first side of the dielectric sheet is attached to the open end with a conductive adhesive.

6. A microstrip-waveguide transition comprising:

a waveguide having an open end;

a dielectric substrate having a first side surface attached to the open end;

a microstrip probe on a second side surface of the dielectric substrate; and a backshort cap attached to the second side surface, wherein the backshort cap has a central portion at a height in relation to the microstrip probe that is less than ½ of a wavelength for a frequency at which the transition operates.

7. The microstrip-waveguide transition according to claim 6, comprising:

two separated conductive plates on the first side surface.

8. The microstrip-waveguide transition according to claim 6, wherein the backshort cap is attached to the second side surface with an adhesive to form a hermetic seal between the backshort cap and the dielectric substrate.

9. A microstrip-waveguide transition comprising:

a waveguide having an open end;

a dielectric substrate having a first side surface attached to the open end;

a microstrip probe on a second side surface of the dielectric substrate; and a backshort cap attached to the second side surface, wherein corners of the waveguide and backshort cap are in alignment and the dielectric sheet is arranged between the waveguide and backshort cap.

10. The microstrip-waveguide transition according to claim 9, comprising:

a means for tuning out capacitive susceptance between the open end and the microstrip probe with inductive susceptance.

11. A microstrip-waveguide transition comprising:

a waveguide having an open end;

a dielectric substrate having a first side surface attached to the open end;

a microstrip probe on a second side surface of the dielectric substrate; and a backshort cap attached to the second side surface, wherein corners of the waveguide and backshort cap are in alignment and the dielectric sheet is arranged between the waveguide and backshort cap, and wherein two separated conductive plates are on the first side surface.

12. A microstrip-waveguide transition comprising:

a waveguide having an open end;

a dielectric substrate being attached to the open end;

a conductive plate being disposed on the dielectric substrate;

a microstrip probe being disposed on a surface of the dielectric substrate in relation to the conductive plate; and a backshort cap of a height in relation to the microstrip probe.

* * * * *